US006477971B2

(12) United States Patent
Green

(10) Patent No.: US 6,477,971 B2
(45) Date of Patent: Nov. 12, 2002

(54) BILGE DRAINAGE SYSTEM

(76) Inventor: Lawrence M. Green, 9740 SW. 72nd Ct., Miami, FL (US) 33156

( * ) Notice: Subject to any disclaimer, the term of this patent is extended or adjusted under 35 U.S.C. 154(b) by 0 days.

(21) Appl. No.: 09/816,433

(22) Filed: Mar. 26, 2001

(65) Prior Publication Data

US 2002/0134291 A1 Sep. 26, 2002

(51) Int. Cl.[7] ..... B63B 13/00
(52) U.S. Cl. ..... 114/197; 114/183 R
(58) Field of Search ..... 114/183 R, 184, 114/197, 198

(56) References Cited

U.S. PATENT DOCUMENTS 3,565,031 A * 2/1971 DePersia ..... 114/185
5,452,677 A * 9/1995 Kirkpatrick ..... 114/198
5,724,908 A * 3/1998 Murray ..... 114/197

* cited by examiner

*Primary Examiner*—Jesus D. Sotelo
(74) *Attorney, Agent, or Firm*—Akerman Senterfitt; Michael C. Cesarano

(57) ABSTRACT

A bilge drainage system for a boat having a through-transom drainage passageway has a through-transom pipe connected to an externally-mounted flange and connected internally to a manually or electronically operated stopcock located near the bottom of the bilge such that the stopcock may be opened, and bilge water drained to the sea, when the boat is traveling through the water on a plane.

10 Claims, 2 Drawing Sheets

BILGE DRAINAGE SYSTEM

BACKGROUND OF THE INVENTION

Many power boats have a manual drain plug located in a through-transom hole in the transom, near the base of the transom and extending through the hull to the rearmost area of the bilge. As a boat undergoes normal usage, it inevitably takes on water which accumulates, and which ultimately works its way down to the bilge. The through-transom drain plug is designed to be removed when the boat is taken out of the water to permit the bilge to drain. For trailered boats, this is a primary means of draining bilge water, and the plug is removed nearly every time the boat is taken out of the water. Gravity will cause the water to flow out of the boat, and will be most effective when the boat is positioned with the through-transom hole at a point that is lower than the interior of the bilge. In larger or non-trailered boats the primary means for bilge drainage may be a bilge pump, although when the boat is hauled for storage, maintenance, or repair, it is common for the through-transom drain plug to be removed, both to drain any water that may be in the bilge, and to provide an exit for rain or other water that may collect in the interior of the boat during storage, maintenance, or repair.

A common method of sealing the through-transom hole during normal boat usage is with an external, threaded plug. When the boat is out of the water, the plug is easily accessible and can be removed using only a wrench. While this method of boat drainage is simple and easy, it has at least two major drawbacks, either of which has been experienced by many, if not most small boat owners at sometime during their lives. First, because the plug is not sealing the drain hole when the boat is out of the water, it must be inserted into the drain hole before the boat is launched. If is it not, the boat will immediately begin to take on water when launched, and the amount of water taken on will depend only upon how long the drain hole has been submerged before the condition is discovered. When the condition is discovered, the boat must immediately removed from the water, if possible, allowed to drain, and the manual plug inserted. If the boat has taken on too much water before the condition was discovered, it may not be possible to remove it from the water using the same means as were used to launch it, and more elaborate and expensive steps to remedy the condition must be used. In addition, when water reaches a critical level in the boat, electrical components and batteries may be adversely affected, and fuel, oil, and other materials may spill and cause environmental damage.

A second drawback to using the standard drain plug is that, in the event that the boat takes on water while afloat and away from land, the water cannot be drained through the drain hole, but must be emptied using an electric or manual bilge pump. Even though a boat planing through the water could theoretically drain its bilge through the drain hole, it is difficult if not impossible for the externally threaded plug to be removed during high speed planing. When a boat capable of high speed plaining does begin to take on water, it must rely solely upon its bilge pump to remove the water and alleviate a potentially dangerous condition. If, for any reason, the bilge pump is inoperable, such as a failure of the boat's electrical system, a merely inconvenient condition can quickly develop into a life-threatening one. Accordingly, there is a need for a bilge drainage system that can be manually operated from inside a boat while the boat is otherwise operable.

SUMMARY OF THE INVENTION

The bilge drainage system of this invention uses a permanent internally-mounted stopcock to provide an open through-transom drain hole that may be manually operated while the boat is riding on a plane. The planing motion of the boat orients the hull such that the base of the transom is at a point that is below the bilge. While planing, bilge water may be drained simply by opening the drainage hole. This means of drainage does not need electrical power or external access to the drainage hole, and requires only that the motor be running and the boat be capable of maintaining sufficient speed to reach a plane so that the water from the bilge may drain as a result of gravity or a pressure differential. The bilge drainage system may be included as a feature provided by the manufacturer in new boats, and may easily be retrofitted into existing boats.

DETAILED DESCRIPTION OF THE DRAWINGS

Figure 1:
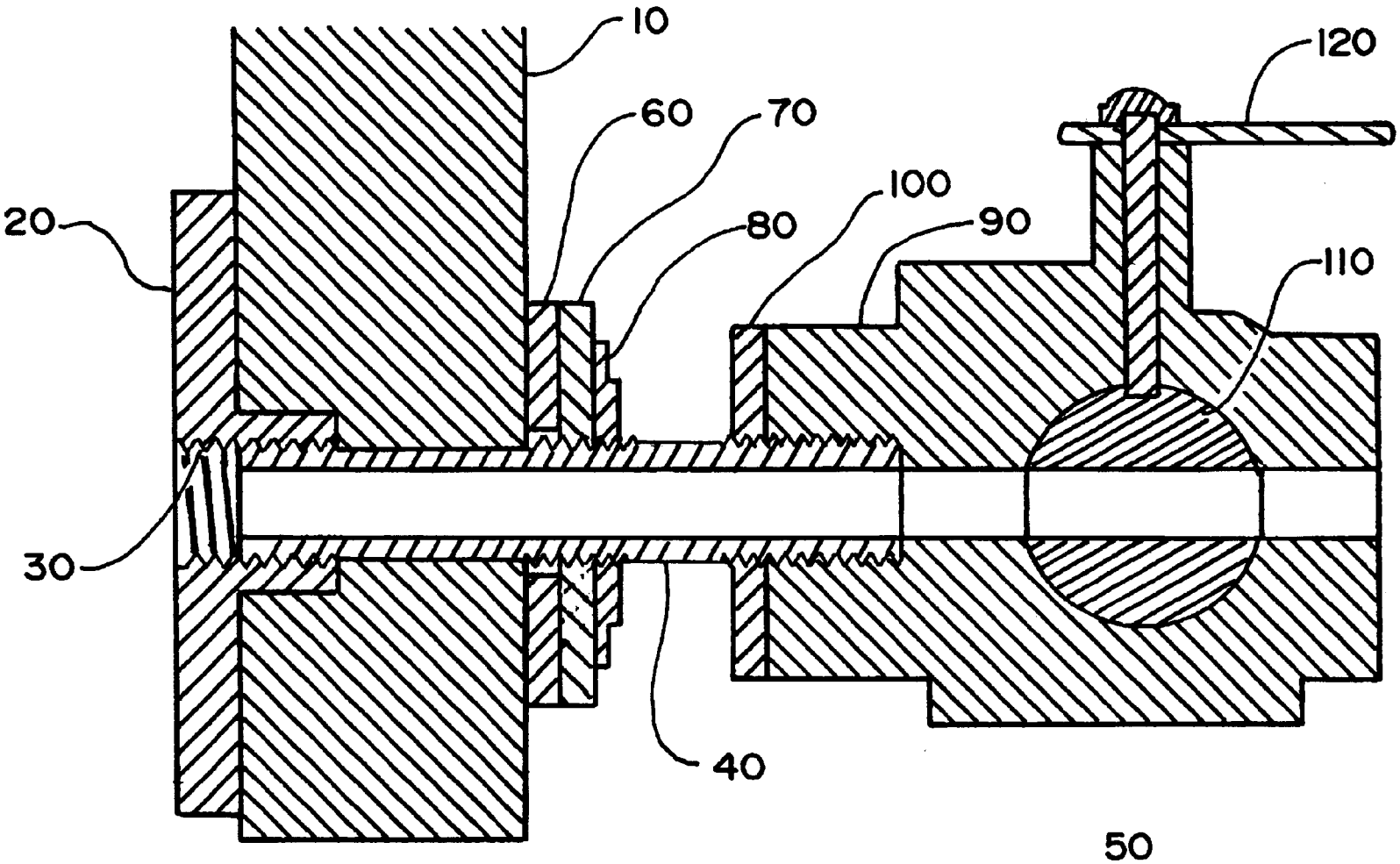
FIG. 1 is a sectional side view of the bilge drainage plug of this invention.

In FIG. 1 it may be seen that a through-transom hole is located near the base of the transom 10. The external member of the bilge drainage system is a short pipe having a flange 20 mounted directly to the exterior surface of the transom using screws or some other suitable means for secure attachment to the transom. The interior surface 30 of the external member is threaded to receive a through-transom pipe 40 that extends through the transom and into the interior bilge area of the boat 50. Where the bilge drainage plug of this invention is installed as original manufacturer's equipment, the external member 20 and through-transom pipe 40 may be cast as a single unit. However, for retrofit installations, it will be necessary to tap the rear of the drain pipe of the external member 20 in order to thread a through-transom pipe 40 into it.

The through-transom hole is sealed on the inside using a resilient, non-corrosive compressible washer 60, a rigid washer of comparable size 70, and a flanged lock nut 80 that screws down on the threaded through-transom pipe. This installation provides not only a strong assembly that can withstand significant wear, tear and abuse, but it also seals the interior of the transom from leaching and other absorption of bilge water and degrading contaminants that may be in the bilge water, thereby prolonging the life and integrity of the transom in the area adjacent to the bilge drain system.

The through-transom pipe may then be extended for whatever length is necessary to make the interior end accessible for manual operation. In determining an appropriate length, however, it is also necessary that the end of the pipe must be located near the bottom of the bilge 50 so that water may enter the pipe when the boat is planing. At the interior end of the pipe a stopcock having a ball valve 110. A second lock nut 100 is tightened against the stopcock to prevent it from becoming loose through vibration. A handle 120 atop the stopcock permits manual operation of the valve.

Figure 2:
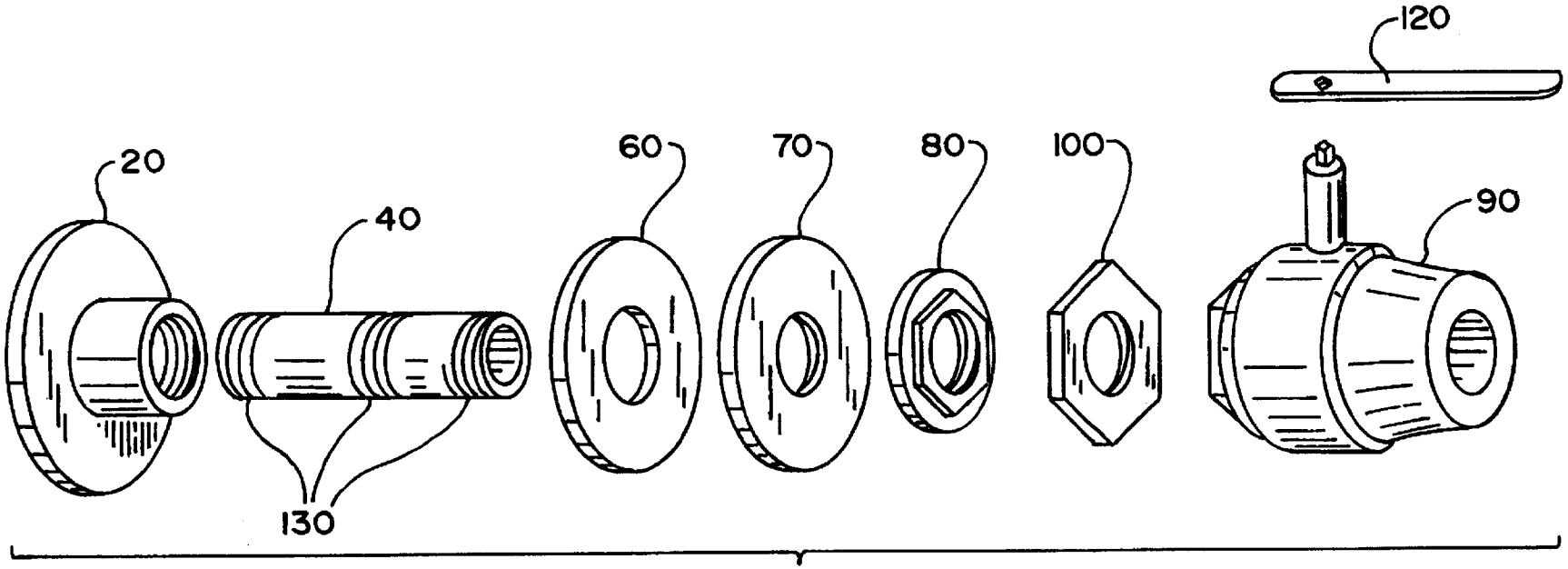
FIG. 2 is an exploded view of the bilge drainage plug and the manner of its mounting in the transom of a boat.

An exploded view of the assembly is shown in FIG. 2. Threaded portions 130 of the 12 through-transom pipe 40 are used to secure the pipe to the external member 20, to secure the compressible 60 and rigid 70 washers against the transom with flanged lock washer 80, and to secure 14 the through-transom pipe to the stopcock 90, further secured with lock nut 100.

Enhancements and modifications may be made to the bilge drainage plug as desired to increase reliability, safety, or ease of use. For example, an electric motor with a disengaging clutch may be used to operate the stopcock with the manual handle being used only if needed as a backup. This configuration would enable the valve to be operated remotely by the boat operator whenever bilge water drainage is desired, so long as the boat is on a plane. Similarly, a float valve, water flow sensor, check valve, or other water-sensitive mechanism could be mounted externally or internally to ensure that the valve is closed, or to electronically close the valve, whenever the boat comes off the plane or otherwise slows sufficiently to allow seawater to flow back through the drainage plug. A manual, remote, or electronic remote valve status indicator may also be provided to signal the boat operator whether the valve is open or closed, and a physical locking mechanism may be placed over the manual handle to prevent accidental movement of the handle without first removing the locking mechanism. Other modifications or enhancements may be added to the invention as disclosed, and such modifications or enhancements will not depart from the scope and spirit of the invention as claimed below.

I claim:

1. A bilge drainage system comprising:

a stopcock and a pipe, said stopcock having a valve, an entry point, and an exit point, said stopcock forming an unobstructed passageway when said valve is open, said entry point being located near the lowest point of the interior of a boat when said boat is traveling on a plane, said exit point being attached to said pipe, said pipe having an unobstructed passageway and extending at least to an unobstructed opening through the lower portion of the rear transom of said boat to form an unobstructed passageway from said entry point to the external terminus of said passageway, said valve being actuable to an open position when said boat is on a plane and to a closed position when said boat is not on a plane, such that water within the interior of said boat may be drained through said unobstructed passageway by gravity flow when said boat is on a plane.

2. The bilge drainage system of claim 1 further comprising an external member attached to the external surface of said transom and forming a seal with said pipe such that water traveling through said pipe and said transom will exit to the sea through said external member.

3. The bilge drainage system of claim 2 in which said pipe extends at least partially through said opening through said transom.

4. The bilge drainage system of claim 3 further comprising means for sealing the interior area of said boat around said opening through said transom such that water and other substances in the interior of said boat will not come into contact with said interior area of said boat around said opening through said transom, or with the interior of said opening through said transom.

5. The bilge drainage system of claim 3 in which said valve has a handle for manual actuation.

6. The bilge drainage system of claim 3 in which said valve may be electronically actuated.

7. The bilge drainage system of claim 3 in which said valve may be remotely actuated.

8. The bilge drainage system of claim 3 in which said passageway forms a straight through path.

9. A bilge drainage system as claimed in claim 8 wherein said passageway is straight.

10. A bilge drainage system for a boat comprising:

An unobstructed passageway having a valve wherein, when said valve is open, liquid contents of a bilge may be drained from the interior of a boat through said passageway to the sea and when said valve is closed, no liquid may flow through said passageway, said passageway having an entrance and an exit, said entrance being situated higher than said exit when said boat is on a plane such that, when said valve is open, the contents of said bilge will flow through said passageway under the force of gravity to cause water from said bilge to drain from said boat into the sea.

* * * * *